US011702115B2

(12) United States Patent
Kress et al.

(10) Patent No.: US 11,702,115 B2
(45) **Date of Patent: *Jul. 18, 2023**

(54) REINFORCED RAILCAR SIDE STAKE

(71) Applicant: JAC Operations, Inc., Chicago, IL (US)

(72) Inventors: Michael H. Kress, Armagh, PA (US); Stephen T. Ling, Johnstown, PA (US)

(73) Assignee: JAC OPERATIONS, INC., Chicago, IL (US)

( * ) Notice: Subject to any disclaimer, the term of this patent is extended or adjusted under 35 U.S.C. 154(b) by 404 days.

This patent is subject to a terminal disclaimer.

(21) Appl. No.: 16/989,105

(22) Filed: Aug. 10, 2020

(65) Prior Publication Data

US 2021/0024104 A1 Jan. 28, 2021

Related U.S. Application Data

(63) Continuation of application No. 15/715,578, filed on Sep. 26, 2017, now Pat. No. 10,737,705.

(60) Provisional application No. 62/399,589, filed on Sep. 26, 2016.

(51) Int. Cl.

| | |
|---|---|
| ***B61D 17/08*** | (2006.01) |
| ***B61F 1/14*** | (2006.01) |
| ***B61D 7/00*** | (2006.01) |

(52) U.S. Cl.

CPC ..... *B61D 17/08* (2013.01); *B61D 7/00* (2013.01); *B61F 1/14* (2013.01)

(58) Field of Classification Search

CPC ..... B61F 1/14; B61D 17/00; B61D 17/08

See application file for complete search history.

(56) References Cited

U.S. PATENT DOCUMENTS

| | | | | |
|---|---|---|---|---|
| 860,029 | A * | 7/1907 | Irwin | B61D 3/08 105/406.1 |
| 1,962,717 | A | 6/1934 | Kiesel | |
| 2,054,783 | A | 9/1936 | Gilpin | |
| 2,146,221 | A * | 2/1939 | Meyer | B61D 17/043 105/411 |
| 2,901,283 | A | 8/1959 | Curell | |
| 6,978,720 | B2 * | 12/2005 | Johnson | B61D 17/08 105/411 |
| 2006/0033359 | A1 * | 2/2006 | Taylor | B60P 3/14 296/182.1 |
| 2015/0329124 | A1 * | 11/2015 | Kuroda | B61D 17/08 105/413 |

(Continued)

*Primary Examiner* — Scott A Browne

(74) *Attorney, Agent, or Firm* — Blynn L. Shideler; Krisanne Shideler; BLK Law Group

(57) ABSTRACT

A reinforced railcar side stake configured to be mounted to the underframe of a rail car and extend upwardly therefrom, the side stake comprises: a main body which is a U shaped channel that includes a flat back generally parallel to the side wall and a pair of legs extending generally perpendicular to the back and the side wall structures, the legs of the main body having cutouts at a lower portion thereof; a connection plate coupled to the side sill main body within the cutouts wherein the connection plate surface is flush with the upper ends of the legs above the cutouts; and a reinforcing plate within the interior of the main body near the coupling of the side stake to the underframe wherein the reinforcing plate overlaps the area of the connection plate by extending both below and above the cutouts in the legs.

9 Claims, 2 Drawing Sheets

(56) References Cited

U.S. PATENT DOCUMENTS

2018/0008635 A1 3/2018 Kress et al.

* cited by examiner

REINFORCED RAILCAR SIDE STAKE

RELATED APPLICATIONS

The present application is a continuation of U.S. patent application Ser. No. 15/715,578 filed Sep. 26, 2017 entitled "Reinforced Railcar Side Stake", which published Mar. 29, 2018, as publication 2018-0086354, and issued Aug. 11, 2020 as U.S. Pat. No. 10,737,705, which publication and application are incorporated herein by reference in their entirety.

U.S. patent application Ser. No. 15/715,578 claims the benefit of Provisional Application Ser. No. 62/399,589 filed Sep. 26, 2016 entitled "Reinforced Railcar Side Stake", which application is incorporated herein by reference.

BACKGROUND OF THE INVENTION

Field of the Invention

The present invention pertains to railcar construction, and more particularly to a reinforced railcar side stake.

Background Information

Railway cars are often used to transport bulk commodities and materials. In transporting such lading, it is desirable to provide railway cars that are efficient with respect to cost and ease of manufacture, load carrying capacity and energy required to move the cars throughout a railway system. Also, railway cars must be designed to meet various government regulatory standards and industry operating standards. For example, the Association of America Railroads (AAR) has established standardized operating envelopes which define maximum allowed exterior dimensions for a wide variety of railway cars. Many advances have been made with respect to making railway cars stronger, lighter, larger in volume, greater load carrying capacity, easier to manufacture, and more aerodynamic. However, the search continues for improved railway cars that are even more efficient and cost effective.

Hopper cars and gondola cars may be used to transport a wide variety of goods and materials such as bulk commodities (corn, wheat, soy beans, etc.) and raw materials (coal, iron ore and other minerals). Gondola cars typically have a pair of sidewalls, a pair of end walls, a solid floor, and no roof. Hopper cars may be either open or covered depending upon the type of bulk lading which will be carried within the respective hopper car. A typical hopper car includes floor sheets which are sloped from the sides and ends of the car to form a series of pockets or hoppers with openings which allow discharge of the bulk lading.

In designing a railway car, it is desirable to maximize volume available for loading, while at the same time, maintaining exterior dimensions of the railway car within the appropriate AAR operating envelope.

Increasing volume may be achieved by minimizing the thickness of the associated sidewalls as long as the sidewalls maintain sufficient strength and durability for the associated loading. Side stakes, sometimes called side posts, are often provided to stiffen sidewalls to help carry lateral loads and beam loads.

Frequently, railway cars, such as hopper cars and gondola cars, have numerous side stakes spaced along each side of the respective car to provide such support. Some conventional hopper cars may have eleven (11) or more side stakes extending along each side of the respective car. Due to mandated AAR loading criteria and real world application, in some conventional side stakes have presented a weak point at the location where the car body joins the car underframe. Current designs have overcome this obstacle by adding reinforcements externally to the side stakes in this area. The limitations of this method include the maximum amount of material to be added before exceeding AAR clearance outline as well as minute structural property improvement by adding reinforcement externally.

There remains a need to optimize the construction of side stake designs and it is an object of the present invention is to provide an effective, efficient, and durable railcar side stake.

SUMMARY OF THE INVENTION

The object of the present invention is achieved according to one embodiment of the present invention by providing the reinforced railcar side stake of the invention which improves the structural properties of the side stake section at the location where the car body joins the car underframe. Adding the reinforcement to an area on the side stake close to the bending moment greatly enhances the bending properties of the member at this area. Also, having the reinforcement on the internal portion of the side stake allows for the reinforcement thickness to not be controlled by the clearance outline, but rather controlled by the structural need present.

Specifically the present invention provides a railcar side stake configured to be mounted to the underframe of a rail car and extend upwardly therefrom, the side stake comprising: a main body which is a U shaped channel that includes a flat back generally parallel to the side wall and a pair of legs extending generally perpendicular to the back and the side wall structures, the legs of the main body having cutouts at a lower portion thereof; a connection plate coupled to the side sill main body within the cutouts wherein the connection plate surface is flush with the upper ends of the legs above the cutouts; and a reinforcing plate within the interior of the main body near the coupling of the side stake to the underframe wherein the reinforcing plate overlaps the area of the connection plate by extending both below and above the cutouts in the legs.

One aspect of the invention may be defined as providing a reinforced railcar side stake configured to be mounted to the underframe of a rail car and extend upwardly therefrom along a sidewall of the railcar, the side stake including a main body which is a U shaped channel that includes a back and a pair of legs extending from the back and toward the side wall of the railcar; a pair of coupling members coupled to the side sill main body at a lower portion thereof, each extending laterally away from one leg of the side sill and including a plurality of mounting holes for coupling the side stake to at least the underframe of the railcar; and a reinforcing plate within the interior of the main body near the coupling of the side stake to the underframe wherein the reinforcing plate overlaps the area of the coupling members by extending both below and above coupling members along the length of the side stake.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

The features that characterize the present invention are pointed out with particularity in the claims which are part of this disclosure. These and other features of the invention, its operating advantages and the specific objects obtained by its use will be more fully understood from the following detailed description.

DESCRIPTION OF THE PREFERRED EMBODIMENTS

Figure 1:
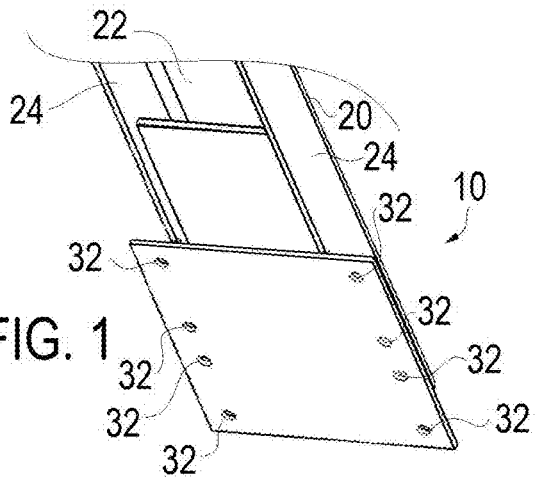
FIG. 1 is a rear perspective view of the lower part of a reinforced railcar side stake according to the present invention.
Figure 2:
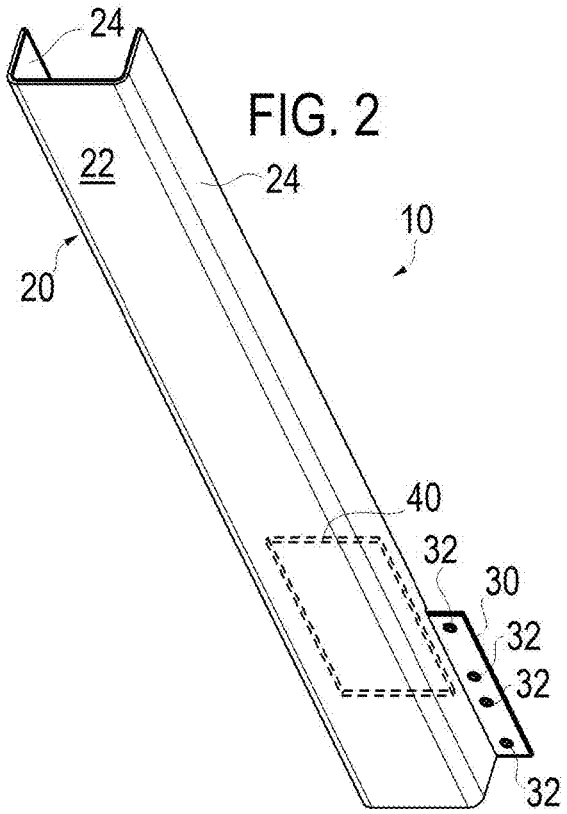
FIG. 2 is a front perspective view of the reinforced railcar side stake according FIG. 1.
Figure 3:
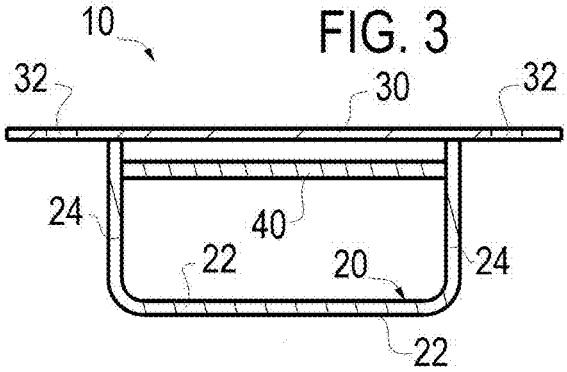
FIG. 3 is a sectional view of the reinforced railcar side stake according FIG. 1 taken along section line A-A of FIG. 5.

As used herein, the singular form of "a", "an", and "the" include plural references unless the context clearly dictates otherwise. Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

A railcar includes conventional wheel trucks mounted at each end thereof in the conventional manner for traveling over steel rails. The wheel trucks are mounted to the underframe of the rail car which generally comprises center and side sills (or beams) and cross beams or tying members joined together in rigid construction to form a load bearing frame. The underframe supports a floor of the rail car and side walls and end walls extend upwardly from the underframe to form a generally rectangular load retaining area within the railcar.

Side stakes 10 according to the present invention are mounted to the underframe, typically to the side sills, and extend upwardly therefrom to provide reinforcement and support for the relatively thin gauge side walls.

Each side stake 10 includes a main body 20 which is a U shaped channel that may be rolled, pressed or extruded. The main body 20 may be effectively cold rolled. The main body 20 of the side stake 10 includes a flat back 22 generally parallel to the side wall of the railcar and a pair of legs 24 extending generally perpendicular to the back 22 and the side wall of the railcar.

Figure 5:
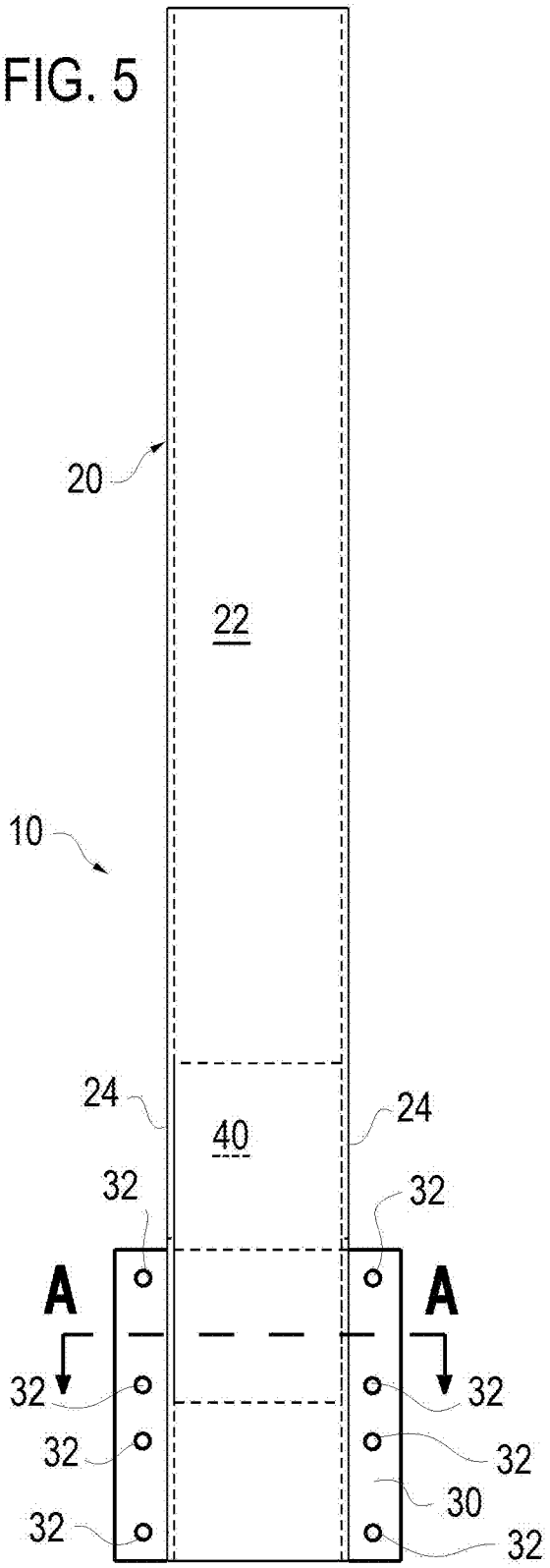
FIG. 5 is a front elevation view of the reinforced railcar side stake according FIG. 1.

The back 22 is referenced as the back 22 as it is the base or bottom or back of the U shape of the main body 20, however in the side stake 10 the back 22 represents the "front" of the side stake 10 of the invention as it is on the front side of the side stake 10 when the side stake 10 is viewed in elevation, as in FIG. 5. Further note that as the side stakes 10 are attached to the sidewalls of a railcar, the front view of the side stake in FIG. 5, would effectively be the view of the side stake 10 shown in an elevated "side view" of the entire railcar. The back 22 in the side stake 10 may also be referenced as the outer side as it is the side farthest from the railcar in an outside stake car.

Figure 4:
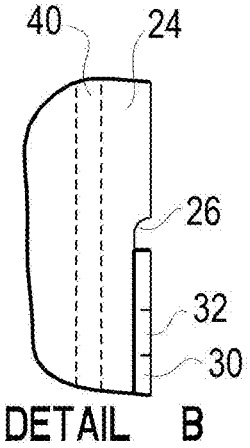
FIG. 4 is an enlarged side elevation view of the reinforced railcar side stake according FIG. 1 of detail B of FIG. 6.
Figure 6:
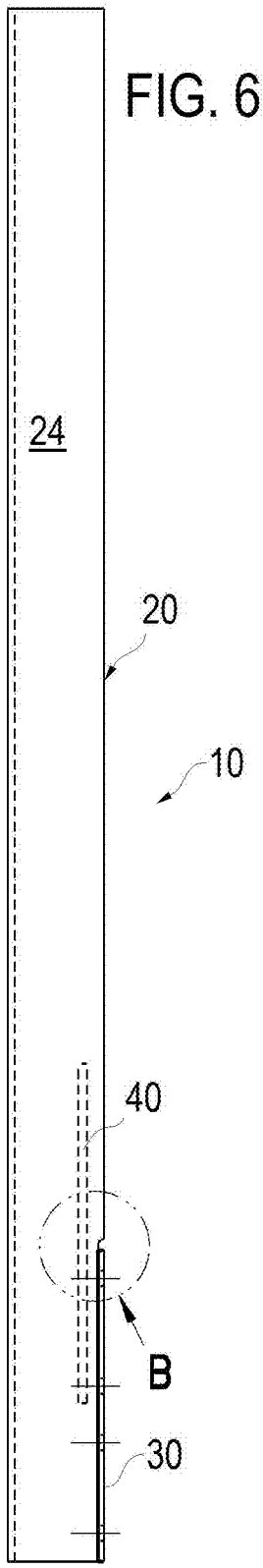
FIG. 6 is a side elevation view of the reinforced railcar side stake according FIG. 1.

Each side stake 10 is mounted at the lower end to the underframe, generally to the side sills, and side wall and possibly the floor by fasteners, such as bolts. The side stake 10 may optionally be coupled to a top chord of a rail car at an upper surface thereof in a conventional fashion. Each side stake 10 includes a connection plate 30 which is welded to the side sill main body 20, namely to the legs 24. The legs 24 of the main body 20 include cutouts 26 to receive the connection plate 30 therein, such that the inner surface of the connection plate 30 is flush with the inner surface of the legs 24 above the cutouts 26 as best shown in FIG. 4 which is an enlarged figure of detail B of FIG. 6. The connection plate 30 includes holes 32 for receipt of conventional fasteners.

The side stake 10 includes a reinforcing plate 40 welded to the interior of the main body 2 near the coupling of the side stake 10 to the underframe. Specifically a 15 inch long reinforcing plate 40 overlaps the area of the connection plate 30 by extending both below and above the cutouts 26 in the legs 24 of the main body 20.

One aspect of the invention may be defined as providing a reinforced railcar side stake 10 configured to be mounted to the underframe of a rail car and extend upwardly therefrom along a sidewall of the railcar, the side stake 10 including a main body 20 which is a U shaped channel that includes a back 22 and a pair of legs 24 extending from the back 22 and toward the side wall of the railcar; a pair of coupling members formed by the outer ends of the connection plate 30 are coupled to the side sill main body 20 at a lower portion thereof, each coupling member end of the connection plate 30 extending laterally away from one leg 24 of the main body 20 of the side sill 10 and including a plurality of mounting holes 32 for coupling the side stake 10 to at least the underframe of the railcar; and a reinforcing plate 40 within the interior of the main body 20 near the coupling of the side stake 10 to the underframe wherein the reinforcing plate 40 overlaps the area of the coupling member ends of the connection plate 30 by extending both below and above coupling members along the length of the side stake 10.

It will be apparent to those of ordinary skill in the art that various changes may be made to the present invention without departing from the spirit and scope thereof. The spirit and scope of the present invention is defined in the appended claims and equivalents thereto.

What is claimed is:

1. A reinforced railcar side stake comprising:

a back at an outer side of the side stake;

a pair of legs coupled to the back with each leg of the pair of legs extending inwardly from the back to an inner leg edge, wherein the back and the pair of legs define a channel with a channel lower end and a channel upper end and with the channel extending longitudinally between the channel lower end and the channel upper end and a channel interior between the legs and the back of the channel;

a pair of coupling members, each coupling member attached to a leg of the pair of legs and having a coupling member lower end and a coupling member upper end and extending laterally away from the inner leg edge of one leg of the pair of legs and including a plurality of mounting holes therein; and a reinforcing plate within the channel interior extending between the pair of legs and outwardly spaced from the inner leg edges, wherein the reinforcing plate has a reinforcing plate lower end and a reinforcing plate upper end with the reinforcing plate extending longitudinally there between, and wherein the reinforcing plate lower end is longitudinally between the channel lower end and the coupling member upper end of each coupling member, and wherein the reinforcing plate upper end is longitudinally between the channel upper end and the coupling member upper end of each coupling member.

2. The reinforced railcar side stake according to claim 1 wherein the reinforcing plate is inwardly spaced from the back.

3. The reinforced railcar side stake according to claim 2 wherein the back is substantially parallel to the sidewall of the railcar.

4. The reinforced railcar side stake according to claim 2 wherein the pair of legs are substantially perpendicular to the back.

5. The reinforced railcar side stake according to claim 2 wherein each of the legs of the pair of legs have cutouts at a lower portion thereof extending from the channel lower end to the coupling member upper end of each coupling member of the pair of coupling members.

6. The reinforced railcar side stake according to claim 5 wherein an inner surface of each of the coupling members is flush with the inner leg edge of the pair of legs longitudinally above the cutouts.

7. A reinforced railcar side stake comprising:

a back at an outer side of the side stake;

a pair of legs coupled to the back with each leg of the pair of legs extending inwardly from the back to an inner leg edge, wherein the back and the pair of legs define a channel having a channel lower end and a channel upper end;

a pair of coupling members, each coupling member attached to a leg of the pair of legs and having a coupling member lower end and a coupling member upper end and extending laterally away from the inner leg edge of one leg of the pair of legs and including a plurality of mounting holes therein; and a reinforcing plate extending between the pair of legs and outwardly spaced from the inner leg edges, wherein the reinforcing plate has a reinforcing plate lower end and a reinforcing plate upper end with the reinforcing plate extending longitudinally there between, and wherein the reinforcing plate lower end is longitudinally between the channel lower end and the coupling member upper end of each coupling member, and wherein the reinforcing plate upper end is longitudinally between the channel upper end and the coupling member upper end of each coupling member.

8. The reinforced railcar side stake according to claim 7 wherein each of the legs of the pair of legs have cutouts at a lower portion thereof extending from the channel lower end to the coupling member upper end of each coupling member of the pair of coupling members.

9. The reinforced railcar side stake according to claim 8 wherein an inner surface of each of the coupling members is flush with the inner leg edge of the pair of legs longitudinally above the cutouts.

* * * * *